US008588641B2

(12) United States Patent
Mimbu et al.

(10) Patent No.: US 8,588,641 B2
(45) Date of Patent: Nov. 19, 2013

(54) IMAGE FORMING APPARATUS

(75) Inventors: Ryuuichi Mimbu, Kanagawa (JP); Kenji Sengoku, Kanagawa (JP); Jumpei Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 275 days.

(21) Appl. No.: 13/108,267

(22) Filed: May 16, 2011

(65) Prior Publication Data

US 2011/0293312 A1 Dec. 1, 2011

(30) Foreign Application Priority Data

May 31, 2010 (JP) ..... 2010-124023

(51) Int. Cl.
*G03G 15/00* (2006.01)
*G03G 15/08* (2006.01)

(52) U.S. Cl.
USPC ..... 399/90; 399/121

(58) Field of Classification Search
USPC ..... 399/90, 121
See application file for complete search history.

(56) References Cited

U.S. PATENT DOCUMENTS

| | | | | |
|---|---|---|---|---|
| 4,099,487 | A * | 7/1978 | Wouters | 399/313 |
| 6,947,693 | B2 | 9/2005 | Kamiya et al. | |
| 7,039,337 | B2 * | 5/2006 | Kawaguchi et al. | 399/90 |
| 7,502,583 | B2 | 3/2009 | Sawai et al. | |
| 7,532,370 | B2 | 5/2009 | Kudo et al. | |
| 7,742,721 | B2 | 6/2010 | Mimbu | |
| 7,773,928 | B2 | 8/2010 | Ogiyama et al. | |
| 2003/0219287 | A1 | 11/2003 | Ogiyama et al. | |
| 2008/0232867 | A1 | 9/2008 | Minbu et al. | |
| 2009/0060611 | A1 | 3/2009 | Minbu | |
| 2009/0142083 | A1 | 6/2009 | Minbu | |
| 2009/0279927 | A1 | 11/2009 | Fujita | |
| 2010/0061741 | A1 | 3/2010 | Minbu | |
| 2010/0067952 | A1 | 3/2010 | Fujita et al. | |
| 2010/0142985 | A1 | 6/2010 | Minbe et al. | |
| 2010/0221029 | A1 | 9/2010 | Minbu et al. | |
| 2011/0064487 | A1 | 3/2011 | Ichihashi et al. | |

FOREIGN PATENT DOCUMENTS

| | | |
|---|---|---|
| JP | 2004-151389 | 5/2004 |
| JP | 2007-328275 | 12/2007 |
| JP | 4625312 | 11/2010 |

* cited by examiner

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

An image foaming apparatus includes an image bearing member, a transfer unit, and a pressing mechanism. The image bearing member bears a toner image. The transfer unit is disposed opposite the image bearing member and is swingably and detachably held within a main body of the image forming apparatus. The transfer unit includes a transfer member and a power receiving electrode. The transfer member is disposed opposite the image bearing member, to contact the image bearing member to form a transfer nip therebetween and transfer the toner image on the image bearing member onto a recording medium in the transfer nip. The power receiving electrode receives power from the main body of the image forming apparatus. The pressing mechanism presses the transfer unit against the image bearing member and includes a power supply electrode that contacts the power receiving electrode of the transfer unit to supply power thereto.

19 Claims, 7 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application No. 2010-124023, filed on May 31, 2010 in the Japan Patent Office, which is hereby incorporated herein by reference in its entirety.

BACKGROUND OF THE INVENTION

1. Field of the Invention

Exemplary aspects of the present invention generally relate to an image forming apparatus, such as a copier, a facsimile machine, a printer, or a multi-functional system including a combination thereof.

2. Description of the Background Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to make the electrostatic latent image visible as a toner image; a transfer device transfers the toner image directly from the image bearing member onto a recording medium or indirectly from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

Such a known transfer device generally includes a transfer member, supplied with a transfer bias, which contacts the image bearing member such as a photoconductive drum and an intermediate transfer belt, thereby defining a transfer nip therebetween, to transfer the toner image onto the recording medium. Further, the transfer device includes a sheet separator to supply a separation bias to the recording medium that exits the transfer nip, thereby separating the recording medium from the image bearing member. The transfer bias and the separation bias are supplied from a power source disposed in a main body of the image forming apparatus.

To supply power from the main body to the transfer device, the transfer device includes a power receiving electrode that contacts a power supply electrode provided to the power source. As the transfer device detachable from the main body is installed in the main body, the power supply electrode of the power source contacts the power receiving electrode of the transfer device, thereby supplying power to the transfer device.

In order to accommodate various thicknesses of recording media sheets, a pressing member, such as a spring, elastically presses the transfer member against the image bearing member so that the transfer member can be separated from the surface of the image bearing member by the thickness of the recording medium passing through the transfer nip.

Additionally, a cleaning blade is provided to contact the transfer member to remove undesirable toner adhered to the transfer member.

In this configuration, if only the transfer member is separable from the surface of the image bearing member, cleaning ability is degraded. For this reason, the transfer device including the cleaning blade is swingably movable relative to the main body of the image forming apparatus. Such a transfer device is pressed against the image bearing member by a pressing mechanism.

As the transfer device is swingably movable and a thick recording medium passes through the transfer nip, the transfer device needs to move by a large amount, thereby separating the power receiving electrode from the power supply electrode. As a result, the bias is not properly applied to the transfer member.

To address such difficulty, the transfer device and the power source of the main body are electrically connected using a harness, thereby permitting the transfer device a certain range of movement. Although advantageous, the harness needs to be removed from the transfer device upon maintenance or the like to prevent the harness from interfering with maintenance. On the other hand, upon installation of the transfer device in the main body, the harness needs to be connected to the transfer device, thereby complicating efforts to facilitate installation and removal of the transfer device.

SUMMARY OF THE INVENTION

In view of the foregoing, in one illustrative embodiment of the present invention, an image forming apparatus includes an image bearing member, a transfer unit, a pressing mechanism, and a power supply electrode. The image bearing member bears a toner image. The transfer unit is disposed opposite the image bearing member, and swingably and detachably held within a main body of the image forming apparatus. The transfer unit includes a transfer member and a power receiving electrode. The transfer member is disposed opposite the image bearing member. The transfer member contacts the image bearing member to form a transfer nip therebetween and transfers the toner image on the image bearing member onto a recording medium in the transfer nip. The power receiving electrode receives power from the main body of the image forming apparatus. The pressing mechanism supports the transfer unit and presses the transfer unit against the image bearing member. The power supply electrode is disposed within the pressing mechanism that contacts the power receiving electrode of the transfer unit to supply power thereto.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
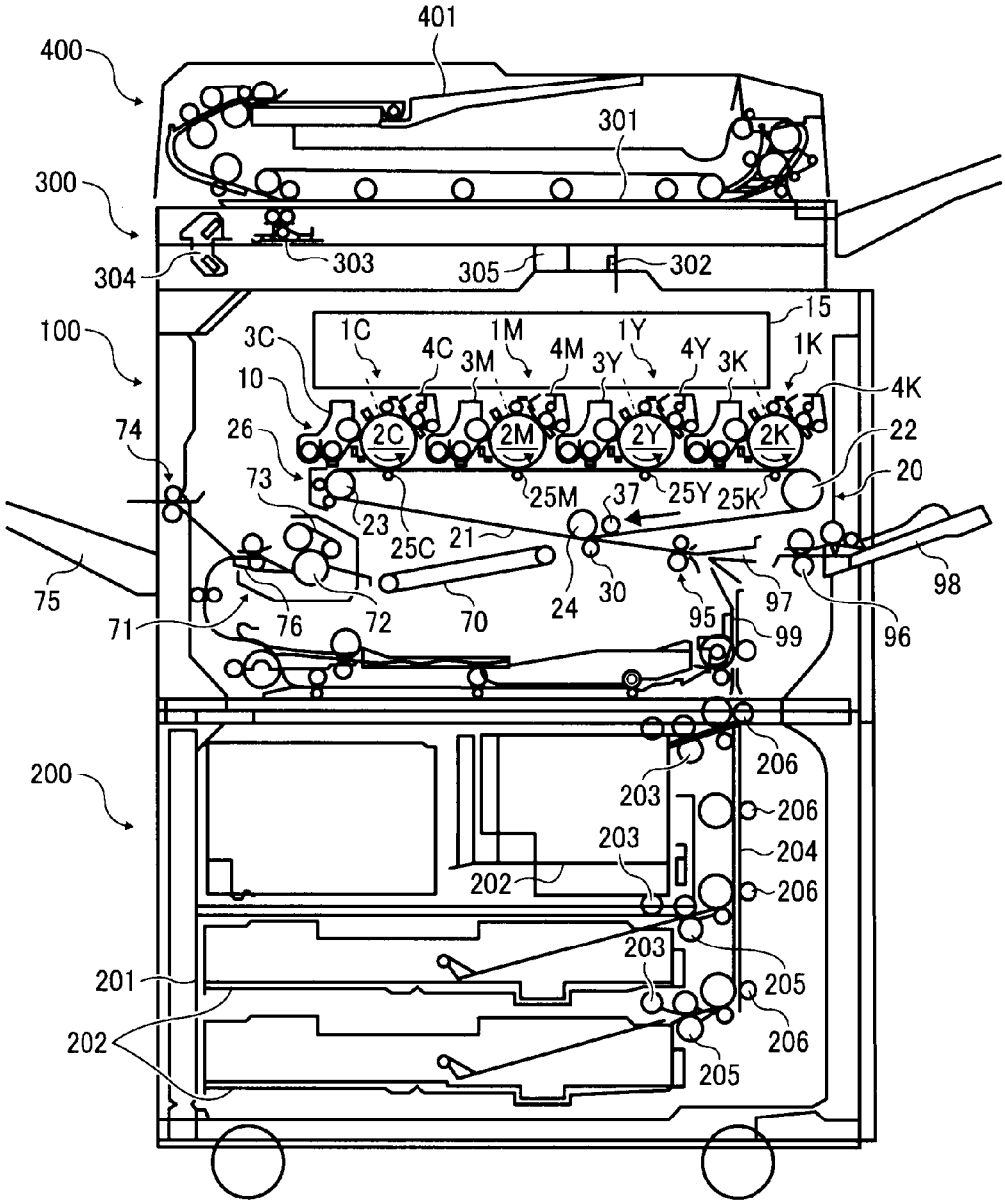
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating a tandem-type color copier as an example of an image forming apparatus according to an illustrative embodiment of the present invention. In FIG. 1, the image forming apparatus includes a printer unit 100, a sheet feeding unit 200, a scanner 300, and an automatic document feeder (ADF) 400. The scanner 300 is disposed substantially above the printer unit 100. The ADF 400 is disposed substantially above the scanner 300.

The printer unit 100 includes a transfer unit 20 including an intermediate transfer belt 21 serving as an image bearing member formed into a loop. As viewed from the side, the loop forms an inverted triangle. The intermediate transfer belt 21 is wound around a drive roller 22, a driven roller 23, and a secondary transfer opposing roller 24. As the drive roller 22 rotates, the intermediate transfer belt 21 moves endlessly in a clockwise direction indicated by an arrow in FIG. 1.

Substantially above the intermediate transfer belt 21, image forming stations 1C, 1M, 1Y, and 1K, one for each of the colors cyan, magenta, yellow, and black, are arranged in tandem in the direction of move of the intermediate transfer belt 21. It is to be noted that reference characters C, M, Y, and K denote the colors cyan, magenta, yellow, and black, respectively. To simplify the description, the reference characters C, M, Y, and K indicating colors are omitted herein unless otherwise specified.

The image forming stations 1C, 1M, 1Y, and 1K include photoconductive drums 2C, 2M, 2Y, and 2K, developing devices 3C, 3M, 3Y, and 3K, and cleaning devices 4C, 4M, 4Y, and 4K, respectively. The photoconductive drums 2C, 2M, 2Y, and 2K are rotated in a counterclockwise direction by a driving device, not illustrated, while contacting the intermediate transfer belt 21, thereby defining primary transfer nips therebetween. The developing devices 3C, 3M, 3Y, and 3K develop electrostatic latent images formed on the photoconductive drums 2C, 2M, 2Y, and 2K with toner of respective colors. The cleaning devices 4C, 4M, 4Y, and 4K remove residual toner remaining on the photoconductive drums 2C, 2M, 2Y, and 2K after the primary transfer process.

In the printer unit 100, the image forming stations 10, 1M, 1Y, and 1K disposed along the belt moving direction constitute a tandem image forming unit 10.

In the printer unit 100, an optical writing unit 15 is disposed above the image forming unit 10. The optical writing unit 15 illuminates the surface of the photoconductive drums 2C, 2M, 2Y, and 2K rotating in the counterclockwise direction to form the electrostatic latent images thereon. Before illuminated with light by the optical writing unit 15, the image forming stations 1C, 1M, 1Y, and 1K are charged uniformly by charging devices.

The transfer unit 20 includes primary transfer rollers 25C, 25M, 25Y, and 25K inside the loop formed by the intermediate transfer belt 21, each facing the respective photoconductive drum 2. The primary transfer rollers 25C, 25M, 25Y, and 25K press the intermediate transfer belt 21 against the photoconductive drums 2.

Substantially below the intermediate transfer belt 21, a secondary transfer roller 30 serving as a transfer member and also as a contact member is disposed. The secondary transfer roller 30 is disposed outside the loop formed by the intermediate transfer belt 21, facing the secondary transfer opposing roller 24, thereby forming a secondary transfer nip. A recording medium is fed to the secondary transfer nip at a predetermined timing. A composite toner image formed on the intermediate transfer belt 21 is secondarily transferred onto the recording medium in the secondary transfer nip.

The scanner 300 includes a contact glass 301 and an image reading device 302. The image reading device 302 reads image information of a document placed on the contact glass 301. The image information is sent to a control unit of the printer unit 100.

Although not illustrated, the control unit includes a central processing unit (CPU), a Random Access Memory (RAM), a Read Only Memory (ROM), and so forth. Based on the image information received from the scanner 300, light sources such as a laser diode and an LED of the optical writing unit 15 in the printer unit 100 project light for cyan, magenta, yellow, and black colors to scan the photoconductive drums 2 and form electrostatic latent images on the photoconductive drums 2. The electrostatic latent images are developed with toner into toner images of cyan, magenta, yellow, and black during the developing process.

The sheet feeding unit 200 includes a paper bank 201 including sheet cassettes 202, sheet feed rollers 203, separation rollers 205, sheet conveyance rollers 206, and so forth. The sheet cassette 202 stores multiple recording media sheets. The sheet feed roller 203 picks up the recording medium from the sheet cassette 202 and sends it to the separation roller 205. The separation roller 205 separates the recording media sheets fed from the sheet feed roller 203 one by one and guides the recording medium to a sheet feed path 204. The sheet conveyance roller 206 conveys the recording medium to a sheet feed path 99 of the printer unit 100.

For manual feed, the image forming apparatus includes a sheet tray 98 and a separation roller 96. The recording media sheets placed on the sheet tray 98 are separated by the separation roller 96 one by one and fed to a manual feed path 97. The manual feed path 97 merges the sheet feed path 99.

Near the end of the sheet feed path 99, a pair of registration rollers 95 is disposed. The pair of registration rollers 95 sandwiches the recording medium conveyed from the sheet feed path 99 and stops the recording medium temporarily. The pair of registration rollers 95 starts to rotate again in appropriate timing to feed the recording medium to the secondary nip.

According to the illustrative embodiment, when making color copies, a document is placed on a document table 401 of the ADF 400. Alternatively, the ADF 400 may be lifted up, and the document is placed on the contact glass 301 of the scanner 300. After placing the document on the contact glass 301, the ADF 400 is closed, and a start button, not illustrated, is pressed. If the document is placed on the ADF 400, the document is conveyed onto the contact glass 301. Subsequently, the scanner 300 is activated, thereby moving a first carriage 303 and a second carriage 304 to scan the document surface. The light source of the first carriage 303 illuminates the document surface with light. The reflected light on the document is deflected to the second carriage 304. Then, the deflected light is deflected by the second carriage 304 and incidents upon the image reading device 302 through an imaging lens 305. Accordingly, the document is read.

When receiving the image information from the scanner 300, the recording medium having a size corresponding to the image information is fed to the sheet feed path 99, and The drive roller 22 is driven by the drive motor, thereby moving the intermediate transfer belt 21 in the clockwise direction. In the meantime, the photoconductive drums 2 of the image forming stations 1 start to rotate. Image forming processes such as charging, optical writing, and development are performed while the photoconductive drums 2 rotate. Accordingly, the toner images of cyan, magenta, yellow, and black are transferred onto the intermediate transfer belt 21 in the primary transfer nips so that the toner images are superimposed atop the other, thereby forming a composite toner image.

In the sheet feeding unit 200, one of the sheet feed rollers 203 is selected to rotate so as to pick up a recording medium in a proper size. The recording medium picked up by the sheet feed roller 203 is separated from the stack of sheets by the separation roller 205 one sheet at a time. Subsequently, the recording medium is conveyed to the sheet feed path 99 in the printer unit 100 via the sheet feed path 206.

When using the manual feed tray 98, the sheet feed roller of the manual feed tray 98 is rotated to feed the recording medium to the separation roller 96. The separation roller 96 separates the recording medium from the stack of sheets and feeds it to the manual feed path 97. The recording medium is conveyed to the sheet feed path 99. In the vicinity of the sheet feed path 99, the leading end of the recording medium abuts the pair of registration rollers 95 and the recording medium stops. Rotation of the pair of registration rollers 95 resumes, and the recording medium is sent to the secondary transfer nip in appropriate timing such that the recording medium is aligned with the composite toner image formed on the intermediate transfer belt 21. The composite toner image is secondarily transferred onto the recording medium in the secondary transfer nip by pressure and a transfer electric field.

The recording medium onto which the toner image is secondarily transferred in the secondary transfer nip is conveyed to a fixing device 71 by a sheet conveyance belt 70. The fixing device 71 includes a pressing roller 72 and a fixing belt 73. The pressing roller 72 and the fixing belt 73 meet and press against each other, thereby forming a fixing nip. The recording medium is sandwiched by the pressing roller 72 and the fixing belt 73, and pressure and heat are applied thereto in the fixing nip. Accordingly, the composite toner image is fixed on the recording medium. The recording medium on which the color image is formed is discharged onto a sheet tray 75 through a pair of the sheet discharge rollers 74.

In a case of duplex printing, the sheet conveyance path of the recording medium discharged from the fixing device 71 is switched by a switching claw 76 to send the recording medium a sheet reversing unit. After the recording medium is turned over, the recording medium is sent to the pair of registration rollers 95. The recording medium is sent again to the secondary transfer nip and then to the fixing device 71.

A belt cleaning device 26 is disposed upstream from the primary transfer nip for cyan which is at the extreme upstream end in the primary transfer process. The belt cleaning device 26 contacts the intermediate transfer belt 21 after the recording medium passes through the secondary transfer nip to remove toner remaining on the surface of the intermediate transfer belt 21.

Figure 2:
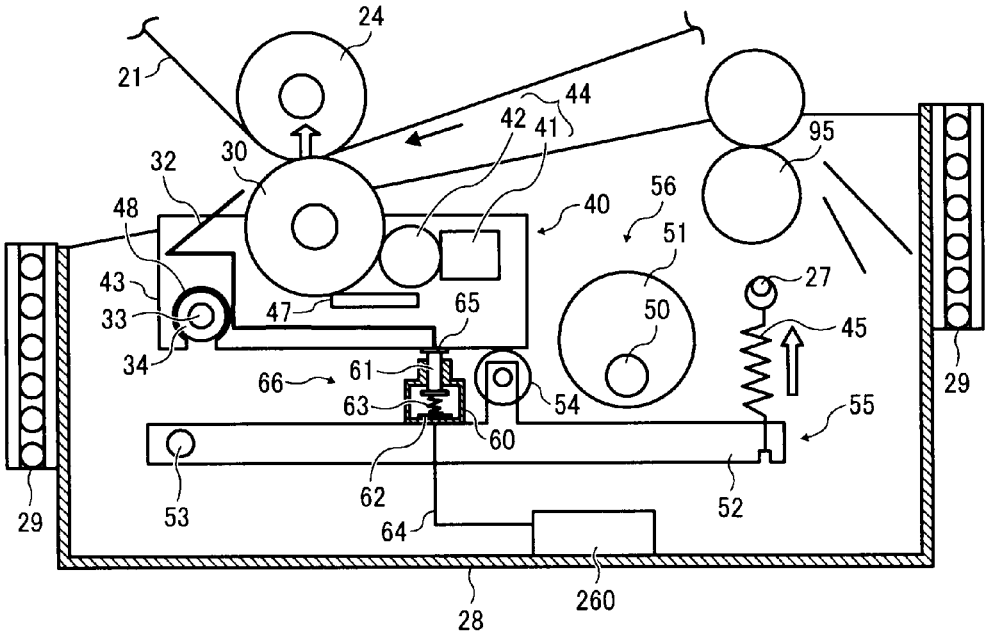
FIG. 2 is a schematic elevational view of a secondary transfer nip defined by an intermediate transfer belt and a secondary transfer roller, and devices near the secondary transfer nip in the image forming apparatus of FIG. 1.
Figure 3:
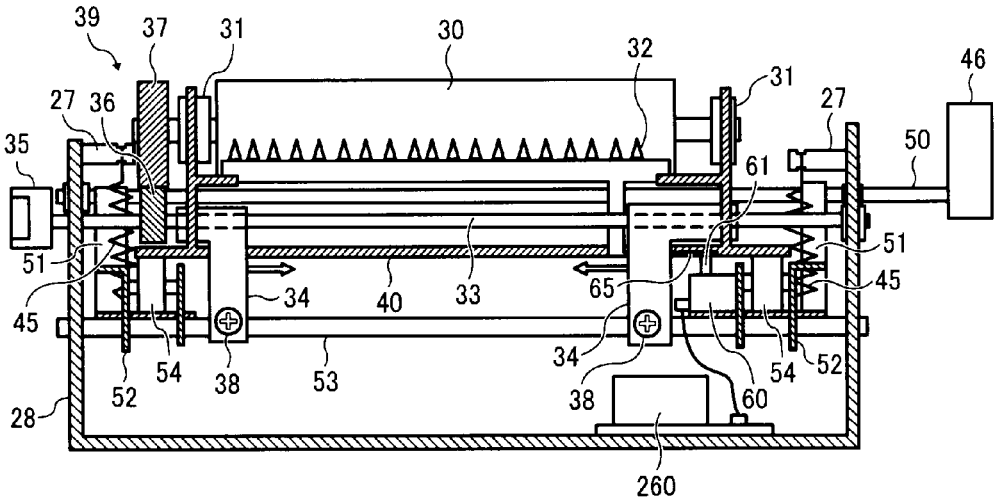
FIG. 3 is a schematic side view of the secondary transfer nip and the devices near the secondary transfer nip.

With reference to FIGS. 2 and 3, a description is provided of the secondary transfer nip and the devices near the secondary transfer nip in the printer unit 100 according to the illustrative embodiment. FIG. 2 is a schematic elevational view of the secondary transfer nip and the devices near the secondary transfer nip. FIG. 3 is a side view of the secondary transfer nip and the devices near the secondary transfer nip.

As illustrated in FIG. 2, the secondary transfer opposing roller 24 is disposed inside the loop formed by the intermediate transfer belt 21. The intermediate transfer belt 21 is wound partially around the secondary transfer opposing roller 24. Accordingly, the secondary transfer opposing roller 24 keeps a certain curvature of the intermediate transfer belt 21. The secondary transfer roller 30 disposed outside the loop formed by the intermediate transfer belt 21 contacts the secondary transfer opposing roller 24 through the intermediate transfer belt 21.

The image forming apparatus includes a secondary transfer unit 40 serving as a transfer mechanism, a pressing mechanism 55, a drive transmitter 39 (shown in FIG. 3), and a detachable housing 28. The pressing mechanism 55 presses the secondary transfer unit 40 towards the intermediate transfer belt 21 serving as an image bearing member. The drive transmitter 39 transmits a rotary driving force to the secondary transfer roller 30. The housing 28 is detachable from a main body of the image forming apparatus and supports the secondary transfer unit 40, the pressing mechanism 55, the pair of registration rollers 95, and so forth. Slide rails 29 are each disposed at side surfaces of the housing 28. The housing 28 can be pulled out to the front.

The secondary transfer unit 40 includes the secondary transfer roller 30, a cleaning blade 47, a lubricant applicator 44, a discharge device 32, a roller unit retainer 43, and so forth. The roller unit retainer 43 holds the secondary transfer roller 30, the cleaning blade 47, the lubricant applicator 44, and the discharge device 32. The roller unit retainer 43 is rotatably held by a rotary shaft 33 through a shaft bearing 34. The rotary shaft 33 transmits the rotary driving force to the secondary transfer roller 30. The roller unit retainer 43 is rotatable about the shaft bearing 34. Accordingly, the secondary transfer unit 40 is supported swingably relative to the main body of the image forming apparatus.

The secondary transfer roller 30 serving as a transfer member is rotatably held by the roller unit retainer 43 through a shaft bearing. According to the illustrative embodiment, the secondary transfer roller 30 is connected to ground through a pressing roller 54 while the secondary transfer roller 30 supplies a secondary transfer bias having the same polarity as the polarity of toner to the secondary transfer opposing roller 24. Accordingly, a secondary transfer electric field is formed in the secondary transfer nip between the secondary transfer opposing roller 24 and the secondary transfer roller 30. The secondary transfer electric field moves the toner electrostatically from the secondary transfer opposing roller 24 to the secondary transfer roller 30.

Toner sticks to the surface of the secondary transfer roller 30 contacting the intermediate transfer belt 21 bearing the toner image. If such toner is left on the surface of the secondary transfer roller 30, the toner sticks undesirably to the rear surface of the recording medium in the secondary transfer nip, contaminating the recording medium.

To address such a problem, the secondary transfer unit 40 includes the cleaning blade 47 to mechanically remove the toner adhered to the secondary transfer roller 30. More specifically, an edge of the cleaning blade 47 contacts the surface of the secondary transfer roller 30 to remove the toner from the secondary transfer roller 30.

The secondary transfer unit 40 includes a lubricant applicator 44 to apply a lubricant onto the surface of the secondary transfer roller 30 so as to reduce friction between the cleaning blade 47 and the secondary transfer roller 30. The lubricant applicator 44 includes a brush roller 42, a solid lubricant 41, a lubricant pressing member, not illustrated, and so forth. The lubricant pressing member presses the solid lubricant 41 against the brush roller 42. The brush roller 42 applies the solid lubricant 41 to the secondary transfer roller 30 as the brush roller 42 scrapes the solid lubricant 41. The solid lubricant 41 is made of, for example, zinc stearate. Application of the lubricant reduces friction between the cleaning blade 47 and the secondary transfer roller 30, thereby reducing a rotational load. Further, application of the lubricant prevents the edge of the cleaning blade 47 from undesirable rolling.

The secondary transfer unit 40 includes the discharge device 32 formed of an electrically conductive member. The discharge device 32 is disposed downstream from the secondary transfer roller 30 in the direction of conveyance of the recording medium. The discharge device 32 includes a plurality of projections along its longitudinal axis and is supplied with an alternating bias. A power receiving electrode 65 is disposed on the bottom surface of the roller unit retainer 43 and is connected to the discharge device 32.

Rotation of the intermediate transfer belt 21 cannot rotate the secondary transfer roller 30. In other words, the secondary transfer roller 30 is driven to rotate by the drive transmitter 39. Because the cleaning blade 47 contacts the secondary transfer roller 30, hindering rotation of the secondary transfer roller 30, the secondary transfer roller 30 cannot be rotated by contacting the intermediate transfer belt 21.

As illustrated in FIG. 3, the drive transmitter 39 is disposed at the left end portion of the image forming apparatus (at the distal end). The drive transmitter 39 transmits a rotational force (torque) to the secondary transfer roller 30. The drive transmitter 39 includes a driven gear 36, a transfer gear 37, and so forth. The driven gear 36 is fixed to the rotary shaft 33 rotatably supported by the detachable housing 28 through the shaft bearing.

A coupling 35 is attached to the rotary shaft 33 at the distal end side. The coupling 35 engages a coupling of a drive shaft connected to a roller drive motor serving as a drive source, not illustrated. The rotational force of the roller drive motor is transmitted to the driven gear 36 and the transfer gear 37 through the coupling 35, thereby rotating the secondary transfer roller 30.

Referring back to FIG. 2, the pressing mechanism 55 is disposed substantially below the secondary transfer unit 40, to press the roller unit retainer 43 against the intermediate transfer belt 21. The pressing mechanism 55 is disposed substantially at the front and the back of the image forming apparatus. The pressing mechanism 55 consists of a pressing lever 52, a pressing roller 54, a pressing spring 45, and so forth. The pressing lever 52 is rotatable about a rotary shaft 53.

One end of the pressing lever 52 is rotatably supported by the rotary shaft 53. The other end of the pressing lever 52 is fixed to one end of the pressing spring 45. The other end of the pressing spring 45 is fixed to a spring bearing 27 affixed to a side wall of the detachable housing 28. The pressing roller 54 is disposed substantially at the center of the pressing lever 52, to contact the bottom surface of the roller unit retainer 43 of the secondary transfer unit 40.

The other end of the pressing lever 52, that is, the right side of the pressing lever 52 in FIG. 2, is pushed up by the pressing spring 45. In this configuration, the pressing lever 52 rotates in the counterclockwise direction, enabling the pressing roller 54 attached to the pressing lever 52 to press against the secondary transfer unit 40. Accordingly, the secondary transfer unit 40 rotates about the shaft bearing 34 in the counterclockwise direction, thereby pressing the secondary transfer roller 30 of the secondary transfer unit 40 against the intermediate transfer belt 21. The secondary transfer nip is formed between the secondary transfer roller 30 and the intermediate transfer belt 21.

As illustrated in FIG. 2, a separation unit 56 is disposed in the detachable housing 28, to separate the secondary transfer roller 30 from the intermediate transfer belt 21 in the case of a paper jam or the like. The separation unit 56 includes a cam shaft 50, a cam 51, a drive motor 46 (shown in FIG. 3), and so forth. The cam shaft 50 is rotatably supported by the detachable housing 28 through a shaft bearing. The cam 51 is fixed to the cam shaft 50. The drive motor 46 rotates the cam shaft 50.

Figure 4:
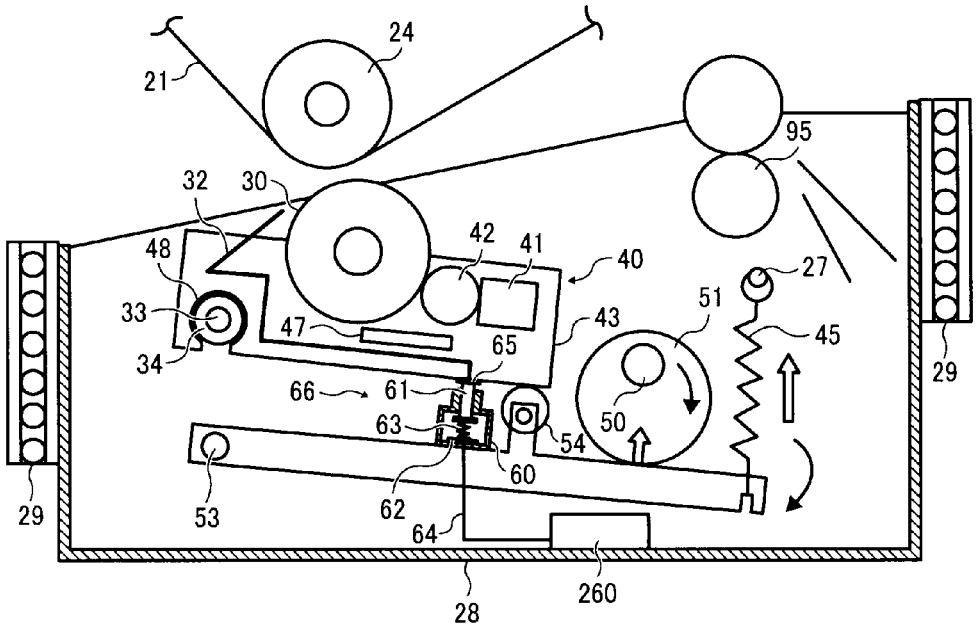
FIG. 4 is a schematic elevational view illustrating the secondary nip and the devices near the secondary transfer nip when the secondary transfer roller is separated from the intermediate transfer belt.

As illustrated in FIG. 4, the cam 51 is rotated to contact the pressing lever 52, thereby rotating the pressing lever 52 about the rotary shaft 53 in the clockwise direction. FIG. 4 is a schematic elevational view illustrating the secondary nip and the surrounding devices when the secondary transfer roller 30 is separated from the intermediate transfer belt. In this case, the pressing force of the pressing spring 45 acts on the cam 51. As a result, no pressing force acts on the secondary transfer unit 40. Hence, the secondary transfer unit 40 rotates about the shaft bearing 34 in the clockwise direction under its own weight, while contacting the pressing roller 54. The secondary transfer roller 30 held by the roller unit retainer 43 separates from the intermediate transfer belt 21.

As illustrated in FIG. 2, the pressing lever 52 at the front side is provided with a power supply unit 66 to supply an alternating bias to the discharge device 32. The power supply unit 66 includes a power supply electrode 61, a conductive plate 62, a compression coil spring 63, a resin holder 60, and so forth. The power supply electrode 61 is formed of a cylindrical conductor that contacts the power receiving electrode 65 of the secondary transfer unit 40. The conductive plate 62 is connected to a power source 260 through a harness 64. The power source 260 is disposed at the bottom of the detachable housing 28. The compression coil spring 63 is a conductive elastic member disposed between the conductive plate 62 and the power supply electrode 61. The resin holder 60 holds the power supply electrode 61, the conductive plate 62, the compression coil spring 63, and so forth.

The resin holder 60 includes a hole through which the power supply electrode 61 is inserted. The compression coil spring 63 has a length longer than the height of the resin holder 60. The compression coil spring 63 is held compressed in the resin holder 60, thereby pressing the power supply electrode 61 against the power receiving electrode 65. Accordingly, the alternating bias is supplied reliably to the discharge device 32. The alternating bias supplied from the power source 260 to the conductive plate 62 through the harness 64 is supplied to the power receiving electrode 65 through the compression coil spring 63 and the power supply electrode 61, and then supplied from the power receiving electrode 65 to the discharge device 32.

The projections of the discharge device 32 generate an electrical discharge towards the back of the recording medium immediately after the recording medium passes through the secondary transfer nip, thereby removing the electrical charge of the recording medium. Accordingly, electrostatic absorption of the recording medium relative to the intermediate transfer belt 21 is reduced, enabling the recording medium to separate from the intermediate transfer belt 21.

As the recording medium is conveyed to the transfer nip, causing the secondary transfer roller 30 to separate from the intermediate transfer belt 21, the secondary transfer unit 40 rotates about the rotary shaft 33 in the clockwise direction. Subsequently, the secondary transfer unit 40 presses the pressing roller 54 so that the secondary transfer unit 40 rotates in the clockwise direction together with the pressing lever 52 against the pressure of the pressing spring 45. As a result, the secondary transfer roller 30 separates from the intermediate transfer belt 21 by an amount corresponding to the thickness of the recording medium being conveyed to the nip, allowing the recording medium to pass through the secondary transfer nip.

In the meantime, the power supply electrode 61 provided to the pressing lever 52 moving together with the secondary transfer unit 40 rotates in the clockwise direction together with the secondary transfer unit 40. With this configuration, reliable connection between the power supply electrode 61 and the power receiving electrode 65 is maintained. Even when a thick recording medium is conveyed to the secondary transfer nip and the secondary transfer unit 40 moves significantly, the power supply electrode 61 and the power receiving electrode 65 remain connected, thereby reliably supplying the alternating bias to the discharge device 32 and hence reliably separating the recording medium from the intermediate transfer belt 21.

The center of rotation of the secondary transfer unit 40 is the rotary shaft 33 to which the driven gear 36 is fixed. Therefore, even when the secondary transfer unit 40 rotates, the distance between the axial center of the secondary transfer roller 30 and the rotary shaft 33 does not change. Hence, even when the secondary transfer unit 40 rotates, the driven gear 36 and the transfer gear 37 fixed to the shaft of the secondary transfer roller 30 remain engaged. Furthermore, even when the secondary transfer unit 40 moves, the rotational force is transmitted to the secondary transfer roller 30, thereby rotating the secondary transfer roller 30.

The pressing roller 54 is a rigid member that does not deform when pressed by the secondary transfer unit 40. With this configuration, fluctuation of the distance between the bottom surface of the secondary transfer unit 40 and the pressing lever 52 is reduced, if not prevented entirely. Furthermore, the power supply electrode 61 is prevented from being pushed undesirably by the secondary transfer unit 40 when the secondary transfer unit 40 moves. Thus, reliable contact is maintained.

The power supply electrode 61 is disposed near the pressing roller 54 that supports the secondary transfer unit 40. In this configuration, fluctuation of the distance between the portion of the pressing lever 52 provided with the power supply device 66 and the bottom surface of the secondary transfer unit 40 is reduced, if not prevented entirely, when the secondary transfer unit 40 moves. The power supply electrode 61 and the power receiving electrode 65 remain in contact reliably.

With reference to FIG. 3, a description is provided of installation and removal of the secondary transfer unit 40 relative to the main body of the image forming apparatus.

Upon removing the secondary transfer unit 40 from the detachable housing 28, the detachable housing 28 is pulled out from the main body. Next, the shaft bearings 34 fitted with the roller unit retainer 43 need to be removed. Because the shaft bearings 34 are fixed to the rotary shaft 53 by screws 38, the screws 38 need to be removed.

The shaft bearings 34 are fixed to the rotary shaft 53 to prevent the shaft bearings 34 from co-rotating undesirably with the rotary shaft 33. Because the shaft bearings 34 are a tubular member made of resin having slidability, the shaft bearings 34 co-rotates undesirably with the rotary shaft 33, thereby hindering its function as a shaft bearing, if the shaft bearings 34 are not fixed.

To address such a difficulty, according to the illustrative embodiment, the shaft bearings 34 are fixed to the rotary shaft 53 that does not rotate. When the screws 38 are removed, the shaft bearings 34 are slidably moved in the direction of arrow in FIG. 3, thereby disengaging the secondary transfer unit 40 and the shaft bearings 34.

As illustrated in FIG. 2, the roller unit retainer 43 includes an engaging portion 48 having a cylindrical shape. The bottom portion of the engaging portion 48 has a notch so that the shaft bearing 34 engages the engaging portion 48 through the notch. The width of the notch is shorter than the external diameter of the shaft bearing 34, but longer than the diameter of the rotary shaft 33. With this configuration, as illustrated in FIGS. 5 and 6, lifting up the secondary transfer unit 40 detaches the secondary transfer unit 40 is detached from the shaft bearing 34 without removing the rotary shaft 33.

Figure 5:
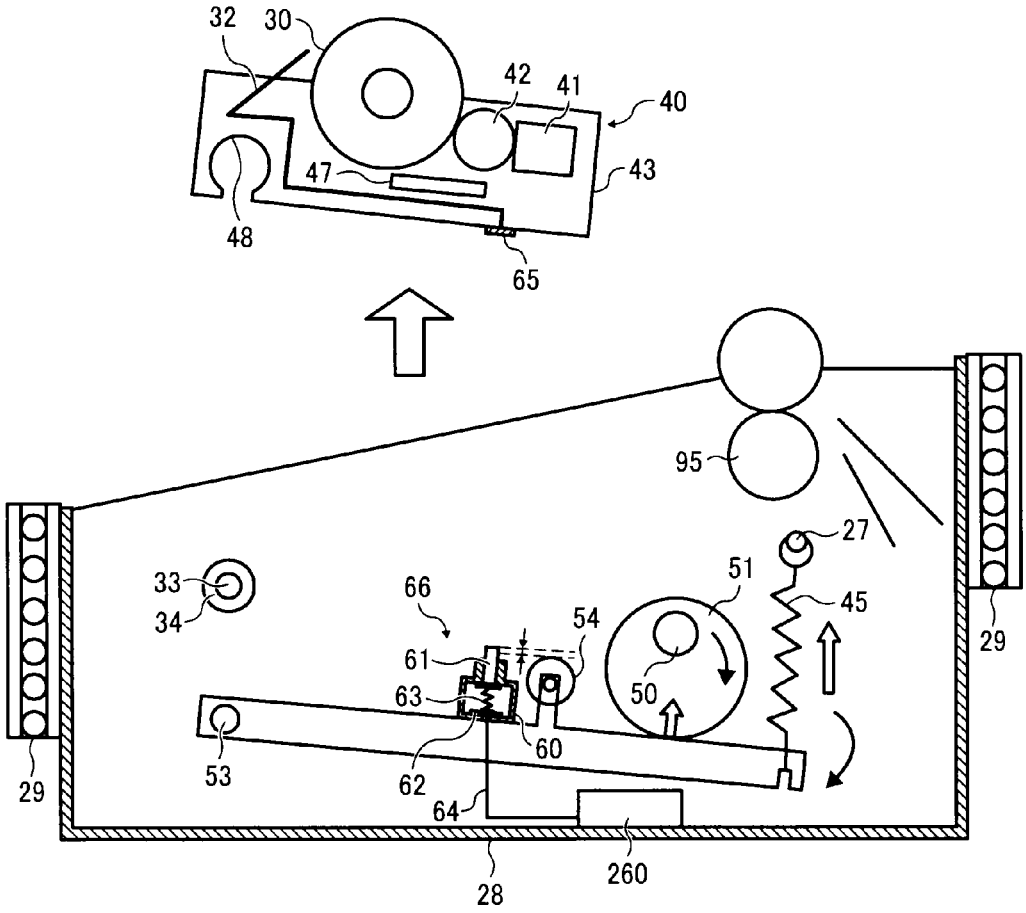
FIG. 5 is a schematic elevational view of a detachable housing when a secondary transfer unit is detached therefrom.
Figure 6:
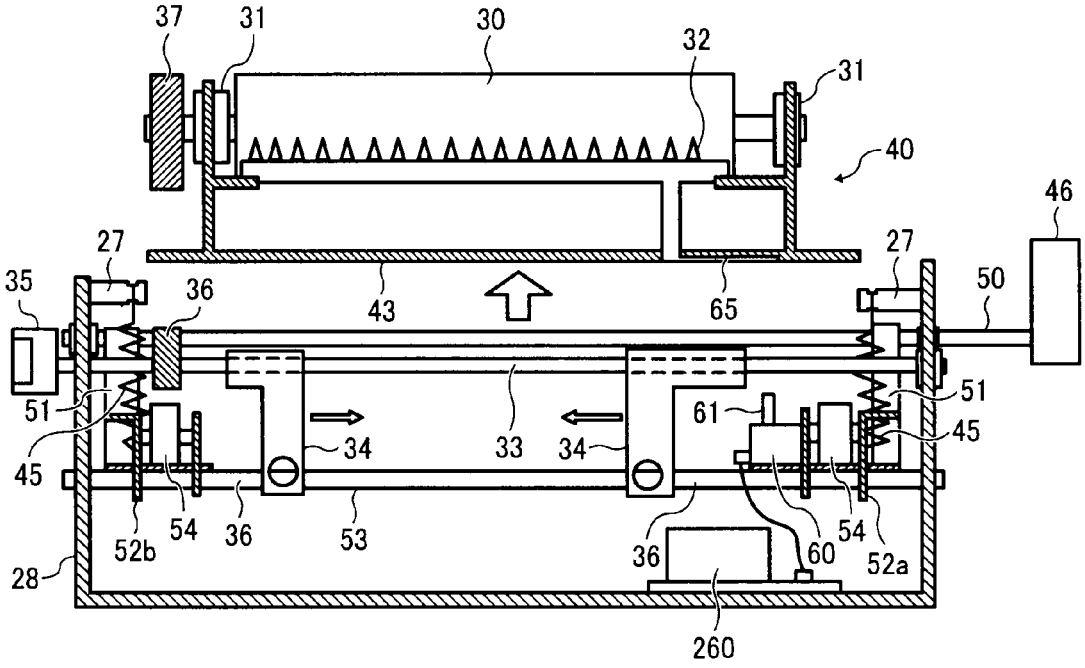
FIG. 6 is a schematic side view of the detachable housing when the secondary transfer unit is detached therefrom.

FIG. 5 is a schematic elevational view of the detachable housing 28 when the secondary transfer unit 40 is detached therefrom. FIG. 6 is a schematic side view of the detachable housing 28 when the secondary transfer unit 40 is detached therefrom.

Having the width of the notch shorter than the external diameter of the shaft bearing 34, the secondary transfer unit 40 is positioned in place relative to the detachable housing 28 by inserting the shaft bearing 34 into the notch of the secondary transfer unit 40. Accordingly, relative positions of the secondary transfer roller 30 and the secondary transfer opposing roller 24 are maintained, thereby providing good transferability.

The power receiving electrode 65 is disposed on the bottom surface of the secondary transfer unit 40, which is the leading surface in the moving direction of the secondary transfer unit 40 when the secondary transfer unit 40 is installed in the main body. When moving the secondary transfer unit 40 up to remove the secondary transfer unit 40 from the main body, the power receiving electrode 65 and the power supply electrode 61 are separated. By contrast, when moving down the secondary transfer unit 40 so as to install the secondary transfer unit 40 in the main body, the power receiving electrode 65 and the power supply electrode 61 contact each other. As described above, the power receiving electrode 65 and the power supply electrode 61 are connected or disconnected electrically in accordance with the movement of the secondary transfer unit 40, thereby simplifying installation and removal of the secondary transfer unit 40 as compared with connecting electrically the parts in the secondary transfer unit 40 using a harness.

As illustrated in FIG. 5, when the secondary transfer unit 40 is detached from the detachable housing 28, the leading end of the power supply electrode 61 comes above the pressing roller 54. By contrast, when the secondary transfer unit 40 is installed in the detachable housing 28, the power supply electrode 61 is pressed down by the secondary transfer unit 40, thereby compressing the compression coil spring 63.

With this configuration, even when manufacturing errors in the pressing roller 54 and the pressing lever 52 cause fluctuations in the distance between the pressing lever 52 and the secondary transfer unit 40, the power supply electrode 61 can reliably contact the power receiving electrode 65.

In a case in which the movement of the secondary transfer unit 40 causes the distance between the portion of the pressing lever 52 provided with the power supply device 66 and the bottom surface of the secondary transfer unit 40 to fluctuate, the power supply electrode 61 slides relative to the resin holder 60 so that the power supply electrode 61 remains in contact with the power receiving electrode 65.

According to the illustrative embodiment, the secondary transfer roller 30 is connected to ground via the pressing roller 54. Alternatively, if the secondary transfer roller 30 can be connected to ground using other parts, the pressing roller 54 may be provided with the power supply electrode 61. The pressing roller 54 supports the secondary transfer unit 40 and moves integrally with the secondary transfer unit 40 while contacting the secondary transfer unit 40. Therefore, the power supply electrode 61 remains in contact with the power receiving electrode 65 by providing the power supply electrode 61 near or to the pressing roller 54.

Figure 7:
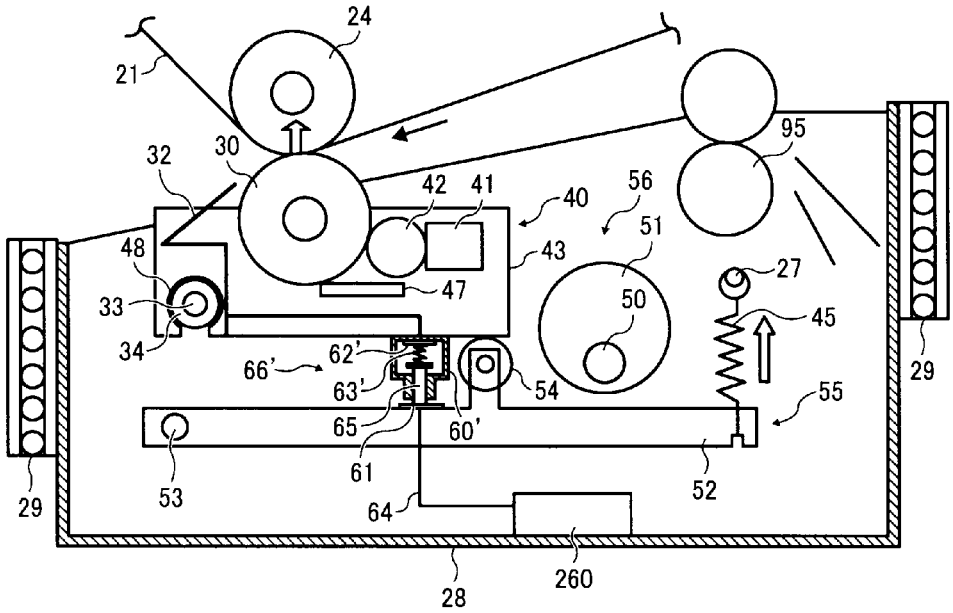
FIG. 7 is a schematic elevational view of the secondary transfer nip and the devices near the secondary transfer nip according to another illustrative embodiment of the present invention.

With reference to FIG. 7, a description is provided of another illustrative embodiment of the present invention. FIG. 7 is a schematic elevational view of the secondary transfer nip and the surrounding structure in the printer unit 100.

As illustrated in FIG. 7, according to the present embodiment, the power receiving portion of the secondary transfer unit 40 includes the power receiving electrode 65, a conductive plate 62' connected to the discharge device 32, a compression coil spring 63', and a resin holder 60'. The power receiving electrode 65 is formed of a cylindrical electrically conductive member. The conductive plate 62' is connected to the discharge device 32. The compression coil spring 63' is conductive and disposed between the conductive plate 62' and the power receiving electrode 65. The resin holder 60' holds the power receiving electrode 65, the conductive plate 62', and the compression coil spring 63'. The power supply electrode 61 connected to the power source 260 via the harness 64 is attached to the pressing lever 52 at the front side.

With this configuration, the compression coil spring 63' presses the power receiving electrode 65 against the power supply electrode 61. When the recording medium is conveyed to the secondary transfer nip moving the secondary transfer unit 40, the power receiving electrode 65 remains in contact with the power supply electrode 61, and the power supply electrode 61 moves together with the secondary transfer unit 40. Accordingly, the alternating bias is supplied reliably to the power receiving electrode 65.

Figure 8:
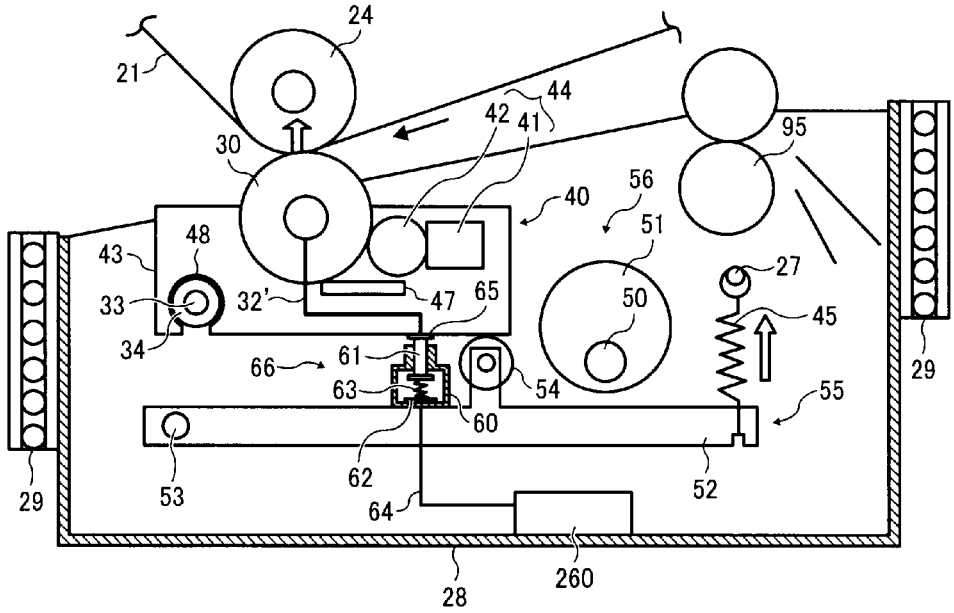
FIG. 8 is a schematic elevational view of the secondary transfer nip and the devices near the secondary transfer nip according to still another illustrative embodiment of the present invention.

With reference to FIG. 8, a description is provided of still another illustrative embodiment of the present invention. FIG. 8 is a schematic elevational view illustrating the secondary transfer nip and the surrounding structure in the printer unit 100 according to still another illustrative embodiment of the present invention.

As illustrated in FIG. 8, the secondary transfer roller 30 is connected to the power receiving electrode 65. According to the present embodiment, the secondary transfer bias is supplied from the power source 260 disposed at the bottom of the detachable hosing 28 to the conductive plate 62 through the harness 64. Subsequently, the secondary transfer bias is supplied to the power receiving electrode 65 through the compression coil spring 63 and the power supply electrode 61, and then to the secondary transfer roller 30 from the power receiving electrode 65.

Figure 9:
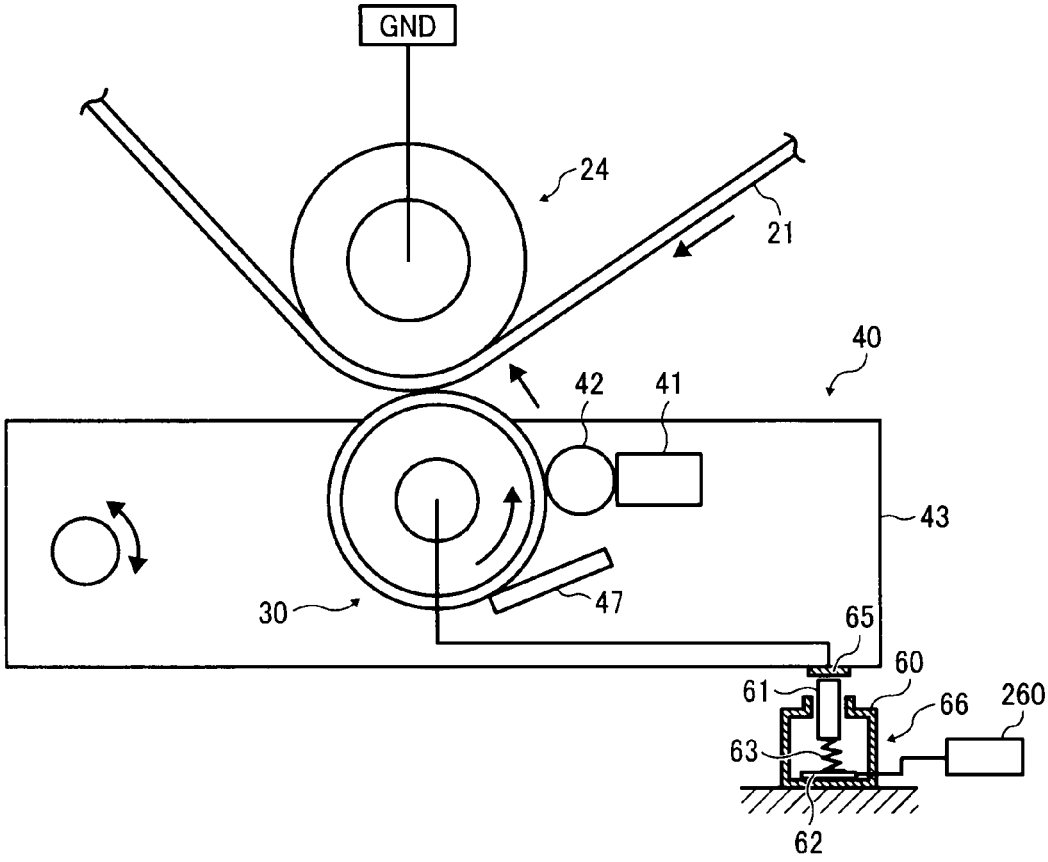
FIG. 9 is a schematic elevational view of the secondary transfer nip and devices near the secondary transfer nip according to yet still another illustrative embodiment of the present invention.

With reference to FIG. 9, a description is provided of yet still another illustrative embodiment of the present invention. FIG. 9 is a schematic elevational view of the secondary transfer nip and the surrounding structure in the printer unit 100 according to yet still another illustrative embodiment of the present invention.

According to the present embodiment, the secondary transfer unit 40 is pressed by the power supply device 66. In this configuration, the compression coil spring 63 held by the resin holder 60 serves as a pressing device that presses the secondary transfer unit 40 against the intermediate transfer belt 21.

As the recording medium is conveyed to the secondary transfer nip and hence the secondary transfer unit 40 moves, the compression coil spring 63 is compressed, moving the power supply electrode 61 together with the secondary transfer unit 40. With this configuration, the power supply electrode 61 remains reliably in contact with the power receiving electrode 65 of the secondary transfer unit 40, thereby supplying reliably the secondary transfer bias to the secondary transfer roller 30.

According to the foregoing embodiments, in the image forming apparatus, the secondary transfer roller serving as a transfer member contacts the intermediate transfer belt to form the transfer nip. The secondary transfer unit is held swingably movable relative to the main body of the image forming apparatus and detachable therefrom.

The image forming apparatus includes the pressing mechanism that presses the secondary transfer unit against the intermediate transfer belt while supporting the secondary transfer unit. The pressing mechanism is provided with the power supply electrode that contacts the power receiving electrode of the secondary transfer unit, to supply power to the secondary transfer unit.

A portion of the pressing mechanism moves integrally with the secondary transfer unit as the secondary transfer unit moves. For example, the pressing lever and the pressing roller of the pressing mechanism move together with the secondary transfer unit. By providing the power supply electrode to the portion moving together with the secondary transfer unit, the power supply electrode remains in contact with the power receiving electrode even when the secondary transfer unit moves. Accordingly, power is supplied from the power source to the secondary transfer unit regardless of the movement of the secondary transfer unit.

According to the illustrative embodiments, when the secondary transfer unit is removed from the image forming apparatus, the power receiving electrode separates from the power supply electrode. By contrast, when the secondary transfer unit is installed in the image forming apparatus, the power receiving electrode and the power supply electrode contact each other. More specifically, the power receiving electrode is disposed on the bottom surface of the secondary transfer unit which is the leading surface in the direction of move of the secondary transfer unit. This configuration facilitates removal of the secondary transfer unit from the main body as compared with removal of the secondary transfer unit after separating the power supply electrode and the power receiving electrode.

This configuration also facilitates installation of the secondary transfer unit in the main body as compared with installing the secondary transfer unit in the main body and then connecting the power supply electrode and the power receiving electrode.

The power supply electrode is provided to the pressing mechanism through the elastic member such as a spring, thereby contacting elastically the power supply electrode against the power receiving electrode. More specifically, as the power supply electrode and the power receiving electrode contact each other while the elastic member is compressed, the power supply electrode pressingly contacts the power receiving electrode. Accordingly, power can be supplied reliably from the power source to the secondary transfer unit.

In this configuration, even when the secondary transfer unit moves and the power receiving electrode separates from the power supply electrode, the power supply electrode follows the movement of the power receiving electrode so that the power supply electrode remains in contact with the power receiving electrode.

The image forming apparatus includes the resin holder that holds the elastic member compressed, thereby pressing the power supply electrode against the power receiving electrode.

Furthermore, the image foaming apparatus includes the detachable housing detachably supported by the main body. The detachable housing holds the secondary transfer unit and the pressing mechanism. When the detachable housing is pulled out from the main body, the secondary transfer unit can be exposed. Accordingly, the secondary transfer unit can be installed or removed relative to the main body with ease.

The secondary transfer unit includes the discharge device made of an electrically conductive member disposed downstream from the secondary transfer nip in the direction of conveyance of the recording medium. The discharge device serves as the recording medium separation device. According to the illustrative embodiment, the discharge device and the power receiving electrode are connected electrically so that power is reliably supplied to the discharge device even when the secondary transfer unit moves. With this configuration, the discharge device causes electric discharge on the recording medium after the recording medium passes through the secondary transfer nip, thereby removing electricity of the recording medium. Accordingly, the recording medium is separated reliably from the intermediate transfer belt.

Alternatively, the secondary transfer roller is electrically connected to the power receiving electrode. With this configuration, the secondary transfer bias is supplied to the secondary transfer roller even when the secondary transfer unit moves.

The rotary shaft is a gear shaft including the driven gear that meshes with the transfer gear of the secondary transfer roller. The secondary transfer unit is rotatably supported by the rotary shaft. With this configuration, even when the secondary transfer unit moves, the transfer gear remain meshed with the driven gear, enabling the secondary transfer roller to rotate.

The transfer device includes the shaft bearing engaging portion that fits the shaft bearing having a cylindrical shape provided to the shaft bearing. The engaging portion includes a notch. The notch has a width greater than the diameter of the rotary shaft. In this configuration, the rotary shaft fits the shaft bearing engaging portion through the notch so that the transfer device can be attached to or detached from the main body without removing the rotary shaft.

The power supply electrode is provided substantially near the portion of the pressing mechanism supporting the secondary transfer unit. The portion of the pressing mechanism supporting the secondary transfer unit moves together with the secondary transfer unit while contacting the secondary transfer unit. Hence, by providing the power supply electrode near the portion of the pressing mechanism supporting the secondary transfer unit, the power supply electrode remains in contact with the power receiving electrode.

According to the illustrative embodiment, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a toner image;

a transfer unit disposed opposite the image bearing member, the transfer unit being swingably and detachably held within a main body of the image forming apparatus, the transfer unit including a transfer member disposed opposite the image bearing member, to contact the image bearing member to form a transfer nip therebetween and transfer the toner image on the image bearing member onto a recording medium in the transfer nip, and a power receiving electrode to receive power from the main body of the image forming apparatus;

a pressing mechanism comprising a pressing element that supports the transfer unit and presses the transfer unit against the image bearing member when the transfer unit is held within the main body of the image forming apparatus; and a power supply electrode disposed within the pressing mechanism, that contacts the power receiving electrode of the transfer unit to supply power thereto, wherein the power supply electrode is provided to the pressing mechanism at a location spaced from the pressing element, and is provided to be movable toward and away from the transfer unit independently of any movement of the pressing element.

2. The image forming apparatus according to claim 1, wherein at least a portion of the pressing mechanism moves together with the transfer unit, and the power supply electrode is provided to the portion of the pressing mechanism that moves together with the transfer unit.

3. The image forming apparatus according to claim 1, wherein as the transfer unit is removed from the image forming apparatus the power receiving electrode separates from the power supply electrode, and as the transfer unit is installed in the image forming apparatus, the power receiving electrode and the power supply electrode contact each other.

4. The image forming apparatus according to claim 3, wherein the power receiving electrode is disposed on a proximal surface of the transfer unit, and contacts the power supply electrode as the transfer unit is installed in the image forming apparatus and separates from the power supply electrode as the transfer unit is removed from the image forming apparatus.

5. The image forming apparatus according to claim 1, further comprising an elastic member biasing the power supply electrode for movement toward the transfer unit relative to the pressing element, wherein the power supply electrode is provided such that the elastic member is compressed when the pressing element supports the transfer unit.

6. The image forming apparatus according to claim 5, further comprising a holder to hold the compressed elastic member.

7. The image forming apparatus according to claim 5, wherein the elastic member is a spring.

8. The image forming apparatus according to claim 1, further comprising a housing detachable from the image forming apparatus and holding the transfer unit and the pressing mechanism.

9. The image forming apparatus according to claim 1, wherein the transfer unit includes an electrically conductive member provided downstream from the transfer nip in the direction of conveyance of the recording medium and connected electrically to the power receiving electrode.

10. The image forming apparatus according to claim 9, wherein the electrically conductive member separates the recording medium from the image bearing member.

11. The image forming apparatus according to claim 1, wherein the transfer member and the power receiving electrode are electrically connected.

12. The image forming apparatus according to claim 11, further comprising:

a drive source;

a gear shaft that rotatably supports the transfer unit; and a drive transmitter including a plurality of gears to transmit a drive force of the drive source to the transfer member of the transfer unit, wherein at least one of the gears is provided to the transfer member to mesh with the gear shaft.

13. The image forming apparatus according to claim 12, wherein the gear shaft includes a cylindrical shaft bearing, and the transfer unit includes an engaging portion including a notch at the bottom thereof to engage the shaft bearing, the notch having a width greater than the diameter of the gear shaft.

14. The image forming apparatus according to claim 1, wherein the power supply electrode is provided to the pressing mechanism where the pressing mechanism supports the transfer unit.

15. The image forming apparatus according to claim 1, wherein the power supply electrode is provided to the pressing mechanism in the vicinity of the place at which the pressing mechanism supports the transfer unit.

16. An image forming apparatus, comprising:

an image bearing member to bear a toner image;

a transfer unit disposed opposite the image bearing member, the transfer unit being swingably held within a main body of the image forming apparatus, the transfer unit including a transfer member disposed opposite the image bearing member, to contact the image bearing member to form a transfer nip therebetween and transfer the toner image on the image bearing member onto a recording medium in the transfer nip, and a power receiving electrode to receive power from the main body of the image forming apparatus;

a pressing mechanism comprising a pressing element and that supports the transfer unit and presses the transfer unit against the image bearing member when the transfer unit is held within the main body of the image forming apparatus;

a power supply electrode disposed within the pressing mechanism, that contacts the power receiving electrode of the transfer unit to supply power thereto; and an elastic member to bias the power supply electrode for movement toward the transfer unit relative to the pressing element, wherein the power supply electrode is provided to the pressing mechanism at a location spaced from the pressing element, and wherein the power supply electrode is provided such that the elastic member is compressed when the pressing element supports the transfer unit.

17. The image forming apparatus according to claim 16, wherein the power supply electrode remains in contact with the power receiving electrode when the transfer unit swings.

18. An image forming apparatus, comprising:

an image bearing member to bear a toner image;

a transfer unit disposed opposite the image bearing member, the transfer unit being swingably held within a main body of the image forming apparatus, the transfer unit including a transfer member disposed opposite the image bearing member, to contact the image bearing member to form a transfer nip therebetween and transfer the toner image on the image bearing member onto a recording medium in the transfer nip, and a power receiving electrode to receive power from the main body of the image forming apparatus;

a pressing mechanism comprising a pressing element and that supports the transfer unit and presses the transfer unit against the image bearing member when the transfer unit is held within the main body of the image forming apparatus;

a power supply electrode disposed within the pressing mechanism, that contacts the power receiving electrode of the transfer unit to supply power thereto; and an elastic member biasing the power supply electrode for movement toward the transfer unit relative to the pressing element, wherein the power supply electrode and the pressing element are not electrically connected, and wherein the power supply electrode is provided such that the elastic member is compressed when the pressing element supports the transfer unit.

19. The image forming apparatus according to claim 18, wherein the pressing element is connected to ground.

* * * * *